United States Patent [19]

Buente

[11] Patent Number: 4,633,827

[45] Date of Patent: Jan. 6, 1987

[54] HYDRAULIC LASH ADJUSTER WITH COMBINED RESERVOIR EXTENSION AND METERING SYSTEM

[75] Inventor: Stephen M. Buente, Battle Creek, Mich.

[73] Assignee: Eaton Corporation, Cleveland, Ohio

[21] Appl. No.: 785,301

[22] Filed: Oct. 7, 1985

[51] Int. Cl.[4] ..... F01L 1/24

[52] U.S. Cl. ..... 123/90.55

[58] Field of Search ..... 123/90.55, 90.57, 90.58, 123/90.46, 90.59

[56] References Cited

U.S. PATENT DOCUMENTS

| | | | |
|---|---|---|---|
| 2,840,063 | 6/1958 | Purchas | 123/90.55 |
| 3,502,057 | 3/1970 | Thompson | 123/90.55 |
| 3,967,602 | 7/1976 | Brown | 123/90.55 |
| 4,437,439 | 3/1984 | Speil | 123/90.55 |
| 4,465,038 | 8/1984 | Speil | 123/90.55 |

*Primary Examiner*—Ira S. Lazarus

*Attorney, Agent, or Firm*—C. H. Grace; C. J. Toddy

[57] ABSTRACT

A hydraulic lash adjuster for valve gear of an internal combustion engine, having a plunger member reservoir chamber with a fluid passageway into the chamber that is substantially lower than the actual vertical height of the chamber and with a reservoir extender means for extending the oil reservoir chamber to a height well above the height of the fluid passageway and a means to precisely meter the flow of oil from the plunger member chamber through a bleed orifice passing through the upper end of the adjuster plunger member with the metering means retained and supported by a reservoir extender means.

6 Claims, 5 Drawing Figures

HYDRAULIC LASH ADJUSTER WITH COMBINED RESERVOIR EXTENSION AND METERING SYSTEM

This invention relates to an improved hydraulic lash adjuster for IC engine valve gear, particularly for a lash adjuster having a plunger member reservoir chamber with a fluid passageway into the chamber that is substantially lower than the actual vertical height of the chamber and with a reservoir extender extending the oil reservoir chamber to a height well above the height of the fluid passageway as shown in U.S. patent application Ser. No. 746,708 filed June 20, 1985, now U.S. Pat. No. 4,584,976, also assigned to Eaton Corporation. More particularly, this invention relates to a lash adjuster having a reservoir extender as disclosed in said application in combination with an arrangement to precisely control the flow of fluid to the top reaction surface of the adjuster plunger.

PRIOR ART DESCRIPTION

U.S. Pat. Nos. 3,070,080 and 2,954,015 disclose lash adjusters having a fluid passage to the fluid chamber and an arrangement for metering oil to the base of a top reaction surface of the hydraulic lash adjuster plunger utilizes a disc shaped member mounted adjacent a bleed hole located in the upper end of the plunger which empties into the plunger element upper reaction surface. However, the above metering technique is not adaptable to a lash adjuster having an oil passage into the reservoir chamber located substantially lower than the actual vertical height of the chamber and an insert to increase the volumetric capacity of the chamber.

SUMMARY OF THE INVENTION

It is an object of this invention to provide a means of precisely metering the flow of oil from the plunger member chamber through a bleed orifice through the upper end of the adjuster plunger member by means of a ball, disk, or other type metering means which is retained and supported by a reservoir extender member or insert.

DESCRIPTION OF THE DRAWINGS

Figure 1:
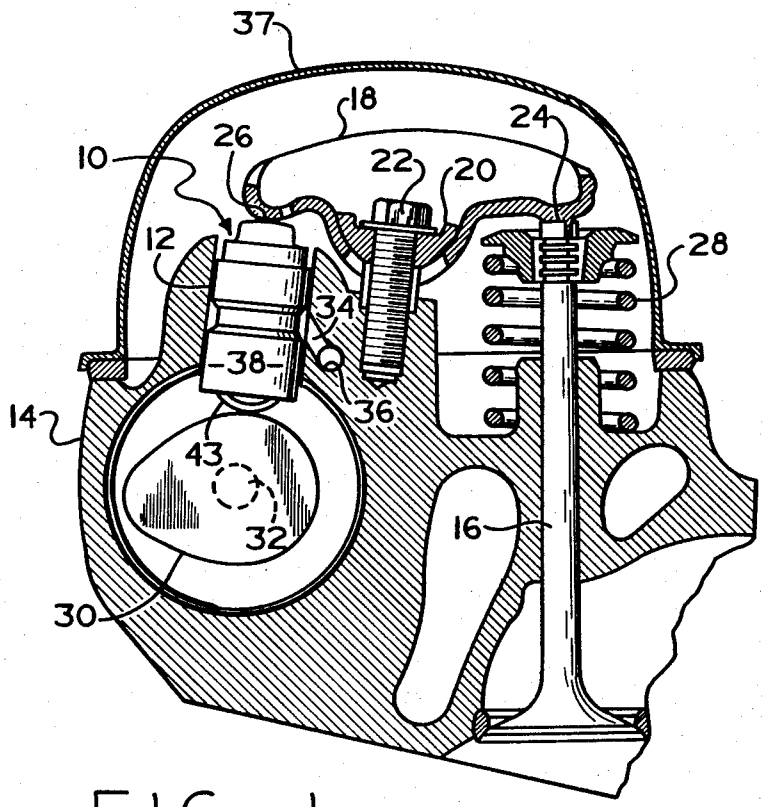
FIG. 1 is a view in elevation of a hydraulic lash adjuster embodying the principals of the invention and shown in association with a center pivot rocker arm valve gear of an internal combustion engine.

Referring to FIG. 1, there is shown generally by reference numeral 10 a hydraulic lash adjuster of the present invention reciprocally mounted in a bore 12 of an internal combustion engine cylinder head 14 having overhead valve gear. Portions of a center pivot rocker arm type valve gear are illustrated including a poppet valve 16 and a rocker arm 18. The rocker arm 18 pivots about a fulcrum member 20 secured to the cylinder head 14 by a retaining bolt 22. Rocker arm 18 contacts the upper end of the poppet valve stem at contact point 24 and contacts the upper end of the hydraulic lash adjuster 10 at contact point 26. A valve spring 28 biases the poppet valve to a closed position while a cam 30 of cam shaft 32 acting through the hydraulic lash adjuster 10 actuates the poppet valve 16 to an open position. Bore 12 communicates with a suitable oil port 34 which port also communicates with an oil gallery 36 provided in cylinder head 14. The oil gallery 36 is connected by suitable passages (not shown) to the engine internal oil supply system, and thus supplies engine oil under pressure to the hydraulic lash adjuster 10. Cover housing 37 is connected to the cylinder head and retains the discharged oil therewithin permitting it to run to the engine sump.

Figure 2:
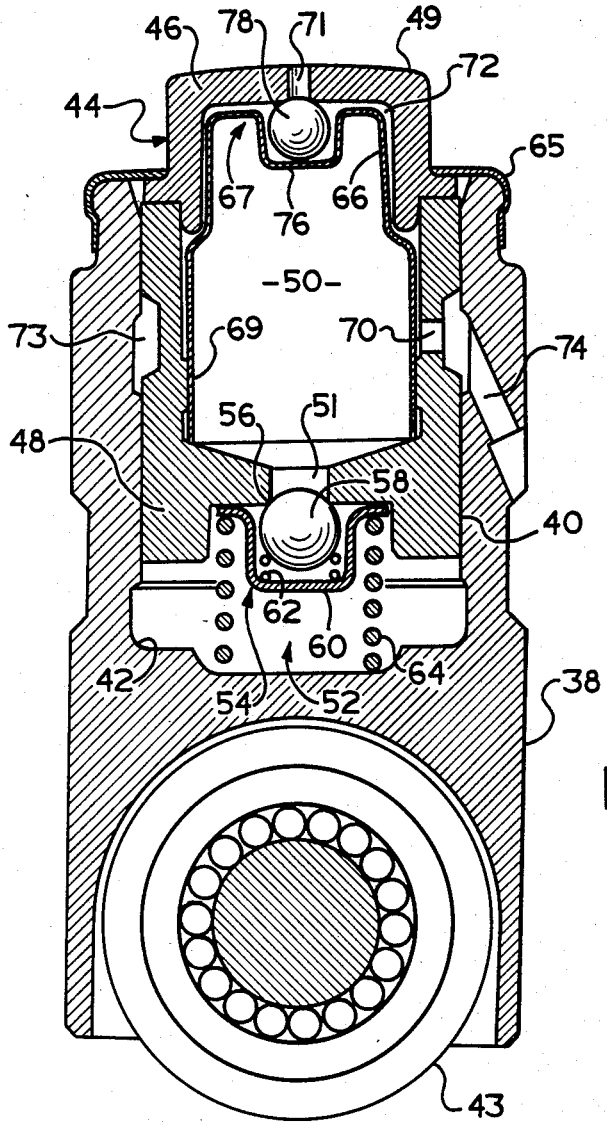
FIG. 2 is a longitudinal cross-sectional view of the lash adjuster shown in FIG. 1.

Referring now to FIG. 2, the hydraulic lash adjuster 10 is shown as having a body 38 preferably of a cylindrical configuration with a bore 40 having a blind end 42 form therein. A roller 43 is rotatably supported by the bottom end of the body 38 and is engagable with cam 30. The roller 43 defines a lower reaction surface or member as will hereinafter be described in greater detail. A plunger means 44 is slidably received in bore 40 in close fitting relationship thereto. The plunger means is shown as being formed by two portions, an upper plunger portion 46 and a lower plunger portion 48. The upper reaction surface 49 is defined by the plunger portion 46 and is engageable with the rocker arm 18 at contact point 26. A fluid reservoir 50 is formed by the central hollow portion of the plunger means 44 with a central passage 51 extending longitudinally through the lower portion 48. A chamber 52 is defined by the lower end of the plunger means and the blind end 42 of bore 40 for retaining oil to maintain the plunger position for lash adjustment. A check valve indicated generally by reference numeral 54 is provided adjacent the end of passage 51 to permit one-way flow of oil from reservoir 50 through passage 51 to the chamber 52.

The check valve 54 preferably has a valve seat 56 formed at the junction of passage 51 and the chamber 52. The check valve 54 has a movable member 58, preferably a check ball, received therein. The member 58 is movable from a closed position contacting the valve seat 56 to an open position spaced from the valve seat. A cage 60 is received over the check valve and serves to retain the check ball 58 therein. A bias spring 62 is provided within the cage to urge the check ball 58 to a closed position in contact with the valve seat 56. A lower plunger member bias spring 64 is provided in the chamber 52 to register against the blind end 42 of the bore 40 to urge the plunger means 44 in a direction away from the blind end 42 of the bore 40. An annular plunger retainer 65 is provided over the upper end of the lash adjuster body 38 with the upper end of the upper plunger member 46 received there through. When no load is present on the plunger means from the associated engine valve gear components, the retainer 65 serves to retain the plunger means 44 in the body against the bias force of spring 64.

The capacity of the oil reservoir 15 is extended or increased to substantially fill the reservoir 50 by a insert member 66. The insert member 66 is an inverted hollow insert preferably having a generally cylindrical configuration having an open end facing towards the closed end of the body member 38. The insert 66 has a generally closed end 67 except for at least one fluid entrance opening 68 The outer periphery 69 of the insert member adjacent its open end is secured in fluid tight sealing engagement with the inner surface of bore 40 below the location of the fluid passageway 70 such as by press fitting of other suitable means. The generally closed end 67 of the insert 66 is located above the location of the passageway 70 and preferably at the highest height possible within reservoir chamber 50 without interferring with bleed orifice 71.

The sides of the insert member 66 generally follow but are closely spaced from the walls of the plunger member 44 a sufficient distance to provide a fluid passageway 72 communicating with a fluid passageway 70. The passageway 70 communicates with an annular groove in the external surface of the plunger which in turn communicates with a passageway 74 extending through the adjuster body 38 and, as shown in FIG. 1, the oil port 34 communicates with the fluid passageway 74. The insert member 66 enables the height h of the reservoir 50 to be increased far above the height H of the passageway 70 to thereby substantially increase the volumetric capacity of reservoir 50.

Figure 3:
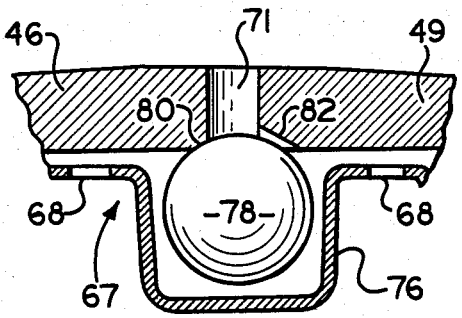
FIG. 3 is an enlargement of a portion of FIG. 2.

Referring to FIG. 3, the closed end 67 of insert 66 is formed with a cup shaped retainer 76 integrally formed with the insert 66 which projects away from the orifice 71 to support and retain a ball 78 in close proximity to a seat 80. Fluid pressure inside the plunger cavity 50 forces the ball 78 against the seat 80. The seat 80 is provided with a slot 82 precisely coined or otherwise formed on the seat so that the amount of fluid passing through the orifice 71 when the plunger cavity 51 is pressurized is precisely controlled or metered.

Figure 5:
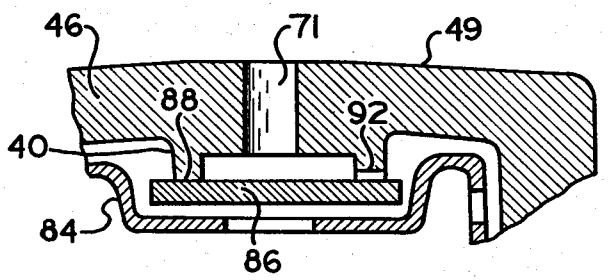
FIG. 5 is an enlargement of a portion of FIG. 4.
Figure 4:
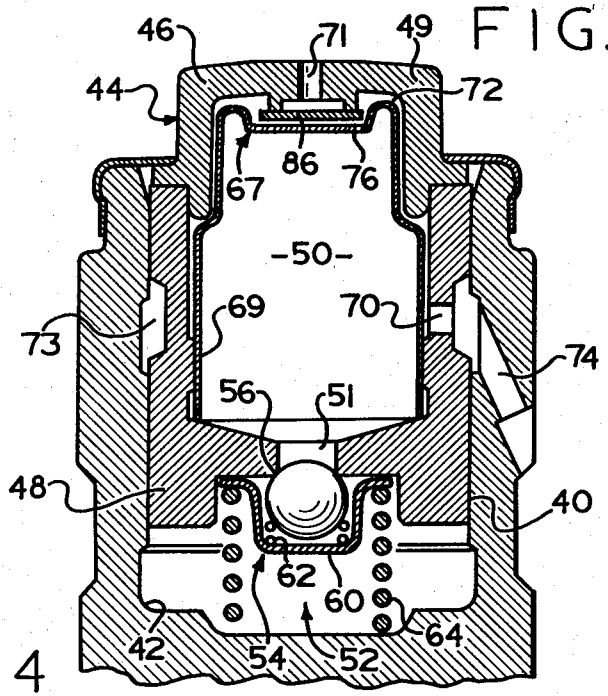
FIG. 4 is a view similar to FIG. 2, but with optional construction.

Referring to FIGS. 4 and 5, a modification of the metering means shown in FIGS. 2 and 3 as shown. The upper portion 67 of the insert 66 is provided with a retainer 84 which is generally dish shaped and integrally formed with the insert. The retainer 84 projects away from the orifice 71 and positions and retains a movable plate 86 in close proximity to a seat 88 formed on the end of the annular projection 90 concentric with the bleed orifice 71. At least one slot 92 is precisely coined or otherwise formed in the face of the seat 88 to precisely control or meter the flow of fluid through the bleed orifice 71.

As an alternative to having a slot in the seat 88, the slot may be omitted and the plate 86 made of a permeable sintered metal so that the flow of fluid through the bleed orifice 81 is controlled by the degree of permeability of the sintered metal plate 86.

Although the hydraulic lash adjuster of the present invention has been described as employed in an overhead cam center pivoted rocker arm type valve gear, it will be appreciated that the hydraulic lash adjuster may also be employed in other types of valve gear arrangements, for example, cam over rocker type or conventional cam in block type valve gear having push rods.

In operation, as the circular portion of cam 30 rotates to a position in contact with the reaction surface 43 of tappet 12 immediately after valve 16 is closed, a small amount of lash or clearance may be present in the valve gear during which chamber 52 is unpressurized. At this point, the check valve ball 58 permits flow of oil from reservoir 50 into chamber 52. Lash is taken out of the valve gear by the combined effects of the oil pressure in chambers 50 and 52 and the upward spring force of spring 64 which lifts the plunger 44 away from the bore end 42 of the body 38. As the cam shaft 32 continues rotating, cam 30 pushs the adjuster 10 upwardly against the spring biased rocker arm 18 opening the poppet valve 16, and in turn, forcing the plunger 44 downwardly which compresses oil trapped in chamber 52. The check valve 54 prevents oil from flowing from chamber 52 into reservoir 50 and thus prevents downward movement of the plunger 44. Throughout motion of the tappet 10 oil from the passageway 72 is supplied to chamber 50 via opening 68 in the insert 66 and is also supplied to the upper reaction surface via the bleed orifice 71 by a precise metered flow through the precisely formed slot 82 or 92.

It is understood that variations and departures can be made from the embodiments of the invention shown and described above without departing from the scope of the appended claims.

What is claimed is:

1. A hydraulic lash adjuster for valve gear of an internal combustion engine comprising:

(a) a body having a blind bore formed therein;

(b) plunger means slidably received in said body bore and defining, in cooperation with the blind end of said bore, a cavity, and a fluid reservoir;

(c) a one way valve means positioned at one end of said plunger means permitting fluid flow from said reservoir to said cavity;

(d) said body and plunger means including port means adapted for receiving fluid under pressure, said port means communicating with said reservoir intermediate the ends of said plunger means;

(e) a cup shaped insert member disposed within said reservoir having an open end secured in fluid tight sealing engagement with the wall of the plunger means between said valve means and port means, the closed end of said insert member positioned in closely spaced relationship to the closed end of said plunger means and having at least one bore extending through the closed end of said insert member;

(f) the closed end of said plunger means having a contact surface adapted to contact associated valve gear components and transmit periodically applied forces and a bleed orifice extending through the closed end of said plunger means and said contact surface, whereby fluid from said port means is communicated to both said insert bore and said plunger bore;

(g) and, a fluid metering means associated with the closed end of said insert and with said bleed orifice to precisely meter the flow of fluid through said bleed orifice.

2. A hydraulic lash adjuster as claimed in claim 1 in which said metering means includes a member movable between said bleed orifice and closed end of said insert and a seat for said member formed adjacent an end of said bleed orifice.

3. A hydraulic lash adjuster as claimed in claim 2 in which said movable member is positioned in close relationship to said seat by a retainer formed in the closed end of said insert.

4. A hydraulic lash adjuster as claimed in claim 3 in which said retainer is cup shaped and said movable member is a ball, said seat having a precisely formed slot therein.

5. A hydraulic lash adjuster as claimed in claim 3 in which said retainer is dish shaped and said movable member is a plate, said seat having a precisely formed slot therein.

6. A hydraulic lash adjuster as claimed in claim 3 in which said retainer is dish shaped and said movable member is a liquid permeable plate.

* * * * *